United States Patent [19]

De Haes et al.

[11] 3,985,561

[45] Oct. 12, 1976

[54] DIFFUSION TRANSFER PROCESS USING SILVER HALIDE EMULSIONS WITH 90% CHLORIDE AND HIGH BINDER TO SILVER HALIDE RATIOS

[75] Inventors: Louis Maria De Haes, Edegem; Leon Louis Vermeulen, Broechem; Hugo Karel Gevers, Edegem; Stephan Jeanne Bongaerts, Berchem; Paul Désiré Van Pee, Edegem, all of Belgium; Werner Krafft, Leverkusen, Germany

[73] Assignee: AGFA-GEVAERT N.V., Mortsel, Belgium

[22] Filed: June 20, 1974

[21] Appl. No.: 481,234

[30] Foreign Application Priority Data

June 22, 1973 United Kingdom ..... 29792/73

[52] U.S. Cl. ..... 96/29 R; 96/76 R; 96/94 R

[51] Int. Cl.[2] ..... G03C 5/54; G03C 1/48; G03C 1/02

[58] Field of Search ..... 96/29 R, 76 R, 94 R

[56] References Cited

UNITED STATES PATENTS

| | | | |
|---|---|---|---|
| 3,615,520 | 10/1971 | Land | 96/76 R |
| 3,666,460 | 5/1972 | Farney | 96/76 R |
| 3,784,381 | 1/1974 | Perignon | 96/94 R |
| 3,806,342 | 4/1974 | Farney et al. | 96/76 R |
| 3,847,617 | 11/1974 | Philippaerts et al. | 96/94 R |

*Primary Examiner*—David Klein
*Assistant Examiner*—Richard L. Schilling
*Attorney, Agent, or Firm*—William J. Daniel

[57] ABSTRACT

A process for producing continuous tone images on an image-receiving material in a diffusion transfer process.

7 Claims, No Drawings

DIFFUSION TRANSFER PROCESS USING SILVER HALIDE EMULSIONS WITH 90% CHLORIDE AND HIGH BINDER TO SILVER HALIDE RATIOS

The present invention relates to a method of producing photographic images according to the well-known silver complex diffusion transfer process. The principle of silver complex diffusion transfer has been described e.g. in the U.S. Pat. No. 2,352,014 of André Rott issued June 20, 1944.

In the silver complex diffusion transfer process, silver complexes are image-wise transferred by diffusion from a silver halide emulsion layer to an image-receiving layer, where they are converted, optionally in the presence of development nuclei, into a silver image. For this purpose, an image-wise exposed silver halide emulsion layer is disposed in or is brought into contact with an image-receiving layer in the presence of a developing substance and a so-called silver halide solvent, converting the non-exposed silver halide into soluble silver complexes. In the exposed parts of the silver halide emulsion layer the silver halide is developed to silver so that it cannot dissolve anymore and consequently cannot diffuse. In the non-exposed parts of the silver halide emulsion layer the silver halide is converted into soluble silver complexes which are transferred to the image-receiving layer where they form a silver, or silver-containing image, usually in the presence of development nuclei. More details on the silver complex diffusion process can be found in "Photographic Silver Halide Diffusion Processes" by A. Rott and E. Weyde, Focal Press, London, New-York (1972).

Silver complex diffusion transfer processes are used in the field of reproduction of documents e.g. technical drawings, printed or written matter and also in so-called "instantaneous photography", the principle of which has been described in J.O.S.A., Vol. 37, no.2, 1947.

For a correct reproduction of the information content of a document special care is taken to preserve the sharpness, contrast and resolution of the reproduction obtained on the image-receiving layer. In the reproduction of documents an appropriate contrast range is necessary between the highlight and shadow areas i.e. between the image and non-image areas of the print. In order to obtain a high maximum density, contrast and resolution in the image-receiving material, it is important to promote the deposition of silver in this material. This promotion can be effected by rapid development of the transferred silver complex e.g. a silver thiosulphate complex so that this complex is incapable of any lateral diffusion in the nuclei-containing image-receiving layer. Means for avoiding such lateral diffusion have been described e.g. in the U.S. Pat. No. 3,257,206 of Louis Maria De Haes issued June 21, 1966. However, diffusion transfer materials for document reproduction are unsuitable for making reproduction of continuous tone originals.

In the reproduction of continuous tone images a considerably lower gradation is required to ensure the correct tone rendering of the system "original-reproduction". Various methods are known for controlling the tone rendering of silver images in the diffusion transfer process e.g. by the use of compounds restraining the diffusion of the silver complex.

It is an object of the present invention to provide a light-sensitive silver halide material that is capable of forming a continuous tone image on or in an image-receiving material by the diffusion transfer process.

The invention resides in a photographic diffusion transfer copying process wherein the light-sensitive layer comprises a silver halide emulsion containing silver chloride and silver iodide and/or silver bromide, the silver halide in said layer being very predominantly silver chloride, and the said layer containing a high weight ratio of hydrophilic colloid with respect to silver halide, such ratio being at least about 3:1. The invention also includes light-sensitive materials having the specified features enabling them to be used in the reproduction of continuous tone images in a diffusion transfer copying process. By a process according to the invention continuous tone images can be successfully reproduced in the image-receiving layer. More particularly the invention provides a process wherein a continuous tone image is produced in or on an image-receiving layer by a diffusion transfer process in which the light-sensitive layer which is used contains a mixture of silver chloride and silver iodide and/or silver bromide dispersed in a hydrophilic colloid binder e.g. gelatin, wherein the silver chloride is present in an amount of at least 90 mole % based on the total mole of silver halide and wherein the weight ratio of hydrophilic colloid to silver halide expressed as silver nitrate is between about 3:1 and about 10:1.

Generally the mole % of silver iodide and/or bromide based on the total mole of halide is comprised between about 0.1 and about 10 mole %, preferably between 0.5 and 5 mole %.

With the materials according to the present invention successful reproduction of continuous tone images can be obtained probably as a result of the presence of silver iodide and/or silver bromide and of the defined high ratio of hydrophilic colloid to silver halide. Without limiting the scope of the invention by the following explanation, it is believed that the high ratio of hydrophilic colloid to silver halide exerts a restraining action upon the particles that diffuse during the silver complex diffusion. This restraining results in a tone rendering that corresponds very closely to the continuous tones of the original. Additional restraining of the diffusion mechanism can be effected by the use of restraining compounds e.g. organic mercapto compounds. The high ratio of hydrophilic colloid to silver halide also offers the additional advantages that the required amount of silver halide can be reduced and that the background area of the reproduction is substantially free from staining.

The preparation of the emulsion is not critical, the silver halide is precipitated by reaction of the chloride ions and iodide ions and/or bromide ions with silver ions. Generally an aqueous solution of silver nitrate is admixed in the presence of a hydrophilic colloid e.g. gelatin with one or more aqueous solutions of halides which include e.g. ammonium, alkali metal e.g. potassium, sodium or lithium, cadmium and strontium halides. The binder for the photosensitive material is preferably gelatin. However, the gelatin may be wholly or partly replaced by other natural and/or synthetic hydrophilic colloids e.g. albumin, casein or zein, polyvinyl alcohol, alginic acids, cellulose derivatives such as carboxymethyl cellulose, etc. The emulsion layer and/or one or more layers in water-permeable relationship with the silver halide emulsion layer may comprise any of the compounds customarily used in such layers for carrying out the silver complex diffusion transfer process. These compounds include e.g. developing agents e.g. hydroquinone preferably in an amount of between 0.3 to 3 g/sq.m and/or 1-phenyl-4-methyl-3-pyrazolidinone preferably in an amount of between 0.075 to 0.75 g/sq.m, coating agents, stabilizing agents, antifogging agents, plasticizers, development modifying agents e.g. polyoxyalkylene compounds and onium compounds, spectral sensitizing agents, etc.

The silver halide emulsion for use in the silver complex diffusion transfer process is usually sensitized for the range of about 530 to about 560 nm. The silver halide emulsion layer used in accordance with the present invention can also be sensitized panchromatically to ensure the reproduction of all colours of the visible part of the spectrum e.g. when black-and-white copies of coloured continuous tone transparencies are made. Another use of panchromatically sensitized light-sensitive materials according to the present invention is the combination of said light-sensitive material with image-receiving layers yielding coloured continuous tone reproductions upon diffusion. The said coloured results can be achieved on either opaque or transparent supports.

The emulsion is generaly coated on a support in such a way that the amount of silver present in the light-sensitive layer corresponds to an amount of silver nitrate ranging from about 0.5 to about 3.5 g/sq.m.

The support for the light-sensitive silver halide emulsion according to the present invention may be any of the supports customarily employed in the art. It includes supports of paper, glass or film e.g. cellulose acetate film, polyvinyl acetal film, polystyrene film, polyethylene terephthalate film etc. as well as metal supports and metal supports laminated at both sides with paper. Paper supports coated at one or both sides with an alpha-olefin polymer e.g. polyethylene can also be used. In order to compensate for the curling tendency of the light-sensitive material it is possible to coat one side of the support with a polyethylene layer whose specific density and/or thickness differs from that at the other side of the support. The compensating action can also be improved by incorporation of matting agents into these coatings.

At least one side of the support is coated with the light-sensitive emulsion layer containing the mixture of silver chloride with silver bromide and/or silver iodide or silver chloroiodide, chlorobromide or chlorobromoiodide.

The emulsion-coated side of the light-sensitive material can be provided with a top layer that is usually free from gelatin and contains water-permeable colloids. The top layer is of such nature that the diffusion is not inhibited or restrained and that it acts e.g. as an antistress layer. Appropriate water-permeable binding agents for the layer coated on top of the light-sensitive silver halide emulsion layer are e.g. methyl cellulose, the sodium salt of carboxymethyl cellulose, hydroxyethyl cellulose, hydroxyethyl starch, hydroxypropyl starch, sodium alginate, gum tragacanth, starch, polyvinyl alcohol, polyacrylic acid, polyacrylamide, polyvinyl pyrrolidone, polyoxyethylene, copoly(methylvinylether/maleic acid), etc. The thickness of this layer may vary according to the nature of the colloid used. Such layer, if present, may be transferred at least partially to the image-receiving layer when the diffusion process comes to an end.

The light-sensitive layer containing silver halide is preferably unhardened.

The image-receiving material according to the present invention may comprise an opaque or transparent support which includes supports of the kind described hereinbefore for the light sensitive layer. Image-receiving layers yielding coloured or black-and-white continuous tone images, can either be coated on a permanent support or on a temporary support.

The image-receiving material may contain development nuclei improving the image formation during the process according to the present invention. Such nuclei have been described in the above-cited publication by A. Rott and E. Weyde, p. 54–57. Preferably nickel sulphide nuclei are used. Nuclei can also be incorporated into the processing liquid as it is described in the United Kingdom Pat. No. 1,001,558, filed Apr. 13, 1962 by Gevaert Photo-Producten N.V.

In one or more layers of the image-receiving material substances may be incorporated, which play a prominent role in the formation of diffusion transfer images. Such substances include black-toning agents e.g. those described in the United Kingdom Pat. No. 561,875, filed Dec. 3, 1942 by Ilford Ltd. and in the Belgian Pat. No. 502,525 filed Apr. 12, 1951 by Agfa A. G. A preferred black-toning agent is 1-phenyl-5-mercaptotetrazole.

The image-receiving layer may consist of or comprise any of the binding agents mentioned hereinbefore for the silver halide. Carboxymethylcellulose is the preferred binding agent for the image-receiving layer.

The image-receiving layer may also comprise fixing agents e.g. sodium thiosulphate in an amount of about 0.1 to about 4 g/sq.m. Developing agents may also be present in the image-receiving materials, preferably hydroquinone e.g. in an amount of about 0.2 g to about 4 g/sq.m, as well as anti-yellowing agents, optical brighteners, etc. The rear side of the image-receiving layer may carry a backing layer.

The processing liquid used in the process of the present invention usually contains alkali substances, such as tribasic sodium phosphate, preserving agents e.g. sodium sulphite, thickening agents e.g. hydroxyethyl cellulose and carboxymethyl cellulose, fog-inhibiting agents such as potassium bromide and if necessary developing agents, development nuclei and silver halide solvents e.g. sodium thiosulphate.

In the silver complex diffusion transfer process according to the present invention separate sheets can be used for the negative or light-sensitive material and for the image-receiving material. However it is also possible to use so-called "mono-sheet" materials wherein both the light-sensitive material and the image-receiving material form part of the same element. The sequence of layers can be chosen in relation to the end result aimed at.

For more particulars about exposure and developing apparatus, which may be applied in a process according to the present invention as well as particulars on the silver halide diffusion process in general there can be referred to "Photographic Silver Halide Diffusion Processes" by A. Rott and E. Weyde, Focal Press London, New-York 1972 and to the patent literature cited therein.

The following examples illustrate the present invention.

EXAMPLE 1

A gelatino silver halide emulsion was prepared by slowly running with stirring an aqueous solution of 1 mole of silver nitrate per liter into a gelatine solution containing per mole of silver nitrate 40 g of gelatin, 1.25 mole of cadmium chloride and 0.01 mole (3.8 g) of cadmium iodide.

The temperature during precipitation and the subsequent ripening process lasting three hours was kept at 40°C.

The emulsion comprising the mixture of silver chloride and silver iodide and containing 210 g of gelatin was cooled, shredded and washed. The washed noodles were molten and another 470 g of gelatin were added during the chemical ripening. After ripening 250 g of gelatin in the form of a 20 % gel solution were added as well as hydroquinone in an amount of 1 g and 1-phenyl-4-methyl-3-pyrazolidinone in an amount of 0.25 g/sq.m emulsion coated surface. The emulsion was coated at one side of a subbed water-resistant paper support consisting of a paper having a weight of 110 g/sq.m coated at both sides with a polyethylene stratum at a ratio of 15 g/sq.m per side.

The emulsion was coated in such a way that an amount of silver equivalent to 2.35 g of silver nitrate was present per sq.m. The gelatin content of the coated layer was 13.5 g/sq.m. The gelatin to silver nitrate ratio was 5.4 and of the total amount of silver halide 97.9 mole % was silver chloride and 2.1 mole % silver iode.

The non-light-sensitive image-receiving material comprised a paper support of 110 g/sq.m coated at both sides with polyethylene at a ratio of 15 g/sq.m per side. This support was treated with a corona whereupon, a layer was coated at a ratio of 18.1 sq.m/l from the following composition:

| | |
|---|---|
| carboxymethyl cellulose | 12 g |
| gelatin | 45 g |
| nickel sulphide nuclei (an aqueous suspension of 2% by weight of gelatin and 0.6% by weight of NiS) | 7 ml |
| water to make | 1000 ml |

The light-sensitive element was exposed to a continuous tone original in a reflex camera, whereupon it was brought with its emulsion side in contact with the image-receiving side of the image-receiving element. While in contact, the materials were run through a common silver complex diffusion transfer apparatus containing a liquid having the following composition:

| | |
|---|---|
| water | 800 ml |
| tribasic sodium phosphate.12 $H_2O$ | 75 g |
| anhydrous sodium sulphite | 40 g |
| potassium bromide | 0.5 g |
| anhydrous sodium thiosulphate | 20 g |
| 1-phenyl-5-mercaptotetrazole | 70 mg |
| water to make | 1000 ml |

When the sandwich of light-sensitive material and image-receiving material left the squeezing rollers of the silver complex diffusion transfer apparatus, the materials were still kept in contact for 60 sec. and then separated from each other.

A true reproduction of the continuous tone original was obtained.

EXAMPLE 2

Silver halide emulsions comprising silver chloride and silver iodide were prepared according to the tehcnique of Example 1 but with an amount of cadmium iodide ranging between 0 and about 16.0 g per mole of silver nitrate.

After exposure to a step wedge with a constant of 0.1 the silver halide material was brought into contact with an image-receiving element comprising 1.24 mg of nickel sulphide per sq.m as described in Example 1.

The results obtained are listed in the following table. It appears that there is a relationship between the presence of iodide ions and the continuous tone effect.

| g $CdI_2$/ mole $AgNO_3$ | gelatin $AgNO_3$ | mole % AgCl | mole % AgI | $D_{min}$ | $D_{max}$ | Amount of reproduced steps |
|---|---|---|---|---|---|---|
| 0 | 5.7 | 100 | 0 | 1.51 | 1.68 | 5 |
| 1.8 | 5.7 | 99 | 1 | 0.11 | 1.77 | 14 |
| 3.8* | 5.7 | 97.9 | 2.1 | 0.14 | 1.75 | 21 |
| 7.2 | 5.7 | 96 | 4 | 0.13 | 0.65 | 21 |
| 16.1 | 5.7 | 91 | 9 | 0.17 | 0.73 | 20 |

*described in Example 1

EXAMPLE 3

Silver halide emulsions were prepared according to the technique of Example 1 but with 3.8 g of cadmium iodide per mole of silver nitrate. The emulsions were coated on a water-resistant paper support at a ratio of 2.3 g of silver nitrate per sq.m, but with different ratios of gelatin to silver halide. After exposure to a step wedge as described in example 2 the silver halide emulsion layer was brought into contact as described in Example 1, with an image-receiving material containing 0.33 g of nickel sulphide/sq.m.

The following results were obtained.

| gelatin $AgNO_3$ | mole % AgCl | mole % AgI | gel/ sq.m | $D_{min}$ | $D_{max}$ | Amount of reproduced steps |
|---|---|---|---|---|---|---|
| 3.5 | 97.9 | 2.1 | 8 | 0.07 | 0.95 | 14 |
| 4.3 | 97.9 | 2.1 | 9.9 | 0.07 | 1.09 | 16 |
| 5.7 | 97.9 | 2.1 | 13.1 | 0.07 | 1.13 | 21 |
| 7.8 | 97.9 | 2.1 | 17.9 | 0.07 | 0.97 | 21 |

EXAMPLE 4

Silver halide emulsions were prepared and tested by methods similar to those described in Example 2 using however cadmium bromide instead of cadmium iodide and different amounts of gelatin. The following results were obtained.

| g $CdBr_2$/ mole $AgNO_3$ | gelatin $AgNO_3$ | mole % AgCl | mole % AgBr | $D_{min}$ | $D_{max}$ | Amount of reproduced steps |
|---|---|---|---|---|---|---|
| 1.3 | 4.3 | 99 | 1 | 0.11 | 1.60 | 12 |
| 1.3 | 5.8 | 99 | 1 | 0.11 | 1.47 | 14 |
| 2.7 | 4.3 | 98 | 2 | 0.12 | 1.52 | 13 |
| 2.7 | 5.8 | 98 | 2 | 0.11 | 0.41 | 15 |
| 5.4 | 4.3 | 96 | 4 | 0.11 | 1.65 | 10 |
| 5.4 | 5.8 | 96 | 4 | 0.11 | 1.60 | 12 |

EXAMPLE 5

The procedure and materials described in Example 1 were used, with the difference however that the image-receiving material comprised a transparent subbed polyethylene terephthalate support containing in addition to the composition described in Example 1, 15 g/l of sodium thiosulphate and that the layer was coated at a ratio of 15.1 sq.m/liter. The continuous tone reproduction obtained can be used in so-called "overhead projection systems". It can also be used in masking techniques in the graphic arts or the copying of X-ray images. The coreproduction of continuous tones and line work, as is usual in lay-out proofing, can be realized by means of the material according to this invention.

We claim:

1. A process for producing continuous tone images on an image-receiving material in a diffusion transfer process comprising the steps of:

a. exposing to a continuous tone original a light-sensitive silver halide emulsion layer containing a mixture of silver chloride and silver iodide and/or silver bromide dispersed in a hydrophilic colloid binder wherein the silver chloride is present in an amount of at least 90 mole % based on the total amount of silver halide and the weight ratio of hydrophilic colloid binder to silver halide expressed as silver nitrate is comprised between about 3:1 and about 10:1, b. wetting the light-sensitive layer while in close contact with an image-receiving layer separate from said emulsion layer by means of an aqueous alkaline composition in the presence of at least one developing agents for the exposed silver halide, at least one silver complexing agents to dissolve the unexposed and undeveloped silver halide, and at least one agents promoting the reduction to metallic silver of said dissolved silver salt complexes to deposit a silver image on the image-receiving material.

2. Process according to claim 1, wherein the hydrophilic colloid binder of the silver halide is gelatin.

3. Process according to claim 1, wherein the gelatin/-silver halide ratio is between 3.5:1 and 6.7:1 by weight.

4. Process according to claim 1, wherein the silver iodide and/or bromide is present in an amount comprised between about 0.5 and about 5 mole % based on the total mole of silver halide.

5. Process according to claim 1, wherein the silver iodide and/or bromide are formed during emulsion preparation by means of the reaction of a cadmium or potassium iodide and/or bromide with silver nitrate.

6. Process according to claim 1, wherein the light-sensitive element comprises as developing agents hydroquinone in an amount of between about 0.3 g and about 3 g/sq.m and 1-phenyl-4-methyl-3-pyrazolidone in an amount of between about 0.075 g and about 0.75 g/sq.m.

7. Process according to claim 1, wherein the alkaline composition contains from about 17.5 g/l to about 50 g/l of sodium thiosulphate.

* * * * *